US006092951A

United States Patent [19]

Greene et al.

[11] Patent Number: 6,092,951

[45] Date of Patent: Jul. 25, 2000

[54] ELECTRO-MECHANICAL WRITING IMPLEMENT

[76] Inventors: Michael Greene, 15344 Weddington St. #217, Sherman Oaks, Calif. 91411; Kenneth Tarlow, 21 Golden Hind Pass., Corte Madera, Calif. 94925; Kirk Langman, 249 S. Robertson Blvd., Beverly Hills, Calif. 90211

[21] Appl. No.: 09/019,369

[22] Filed: Feb. 5, 1998

[51] Int. Cl.[7] ..... B43K 21/02

[52] U.S. Cl. ..... 401/99; 401/195

[58] Field of Search ..... 401/195, 99, 116, 401/151, 52

[56] References Cited

U.S. PATENT DOCUMENTS

| | | | |
|---|---|---|---|
| 4,037,283 | 7/1977 | Moisiuk | 401/195 |
| 4,299,506 | 11/1981 | Hashimoto | 401/195 |
| 4,350,458 | 9/1982 | Murahara et al. | 401/195 |
| 4,634,305 | 1/1987 | Herrnring | 401/151 |

FOREIGN PATENT DOCUMENTS

| | | | |
|---|---|---|---|
| 3142071 | 5/1983 | Germany | 401/195 |
| 3343504 | 9/1985 | Germany | 401/195 |
| 4201479 | 7/1993 | Germany | 401/99 |

*Primary Examiner*—Charles R. Eloshway

[57] ABSTRACT

An article of manufacture for causing a ball point pen cartridge and associated tip to automatically extend from its housing when an actuator switch located at the front end of the pen housing is pressed by the user's finger. The pen tip and associated cartridge automatically retract when the user releases the pen. A D.C. motor coupled to a gear reduction assembly inside the pen housing causes an attached threaded sleeve to rotate within a stationary nut within the housing thereby driving the pen assembly forward or backward depending on the polarity of the electrical supply to the motor. Limit switches within the housing cause the pen assembly to stop at the proper locations. An alternate embodiment of the design substitutes a non-moving, conductive switch that operates on skin contact instead of a moving, mechanical type actuation within a standard electrical switch.

6 Claims, 5 Drawing Sheets

ELECTRO-MECHANICAL WRITING IMPLEMENT

BACKGROUND OF THE INVENTION

This invention relates generally to the field of writing implements, and more particularly to electro-mechanical writing implements.

Writing pens have been in existence for hundreds of years and ball point type pens have been in existence for about fifty years. Although there principally are only two types of pens in use today, split point inkpens and ball point pens, there are literally thousands of styles of pens in existence. The style of pen one uses is often perceived in social terms to say much about a person's socio-economical and emotional status. For example, an executive often makes an unspoken statement about himself by using an expensive pen when signing important documents and the like. Until now the only way to indicate that a pen is expensive is to make it out of exotic or expensive materials such as gold plated metal or the like. The present invention offers a new and novel way to add prestige and expense to a pen by creating the ultimate of ease in activating the pen.

SUMMARY OF THE INVENTION

The primary object of the invention is to provide a novel pen that automatically extends its point when in use and retracts its point when not in use.

Another object of the invention is to provide a pen that is practically effortless to use.

A further object of the invention is to provide a pen that extends and retracts its writing point quickly.

In accordance with the present invention, an electro-mechanical writing implement comprises a generally cylindrical housing having a holding end where a user would hold the writing implement when writing, a motor and power supply housed within the generally cylindrical housing, a writing cartridge connected to the motor by a shaft, and an actuator switch engaging the motor to advance and/or retract the writing cartridge from the housing so that the cartridge is advanced when a user is writing and withdrawn in the housing when the user is not writing.

Other objects and advantages of the present invention will become apparent from the following descriptions, taken in connection with the accompanying drawings, wherein, by way of illustration and example, an embodiment of the present invention is disclosed.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limited, but rather as a basis for the claims and as a representative basis for teaching one skilled in the art to employ the present invention in virtually any appropriately detailed system, structure or manner.

Figure 1:
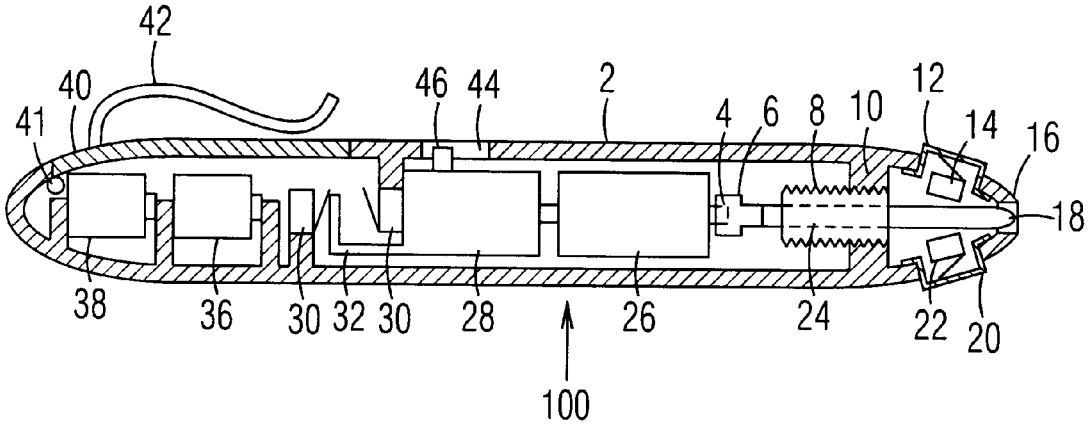
FIG. 1 is a cross-sectional view of the present invention showing the pen cartridge in a retracted position.
Figure 2:
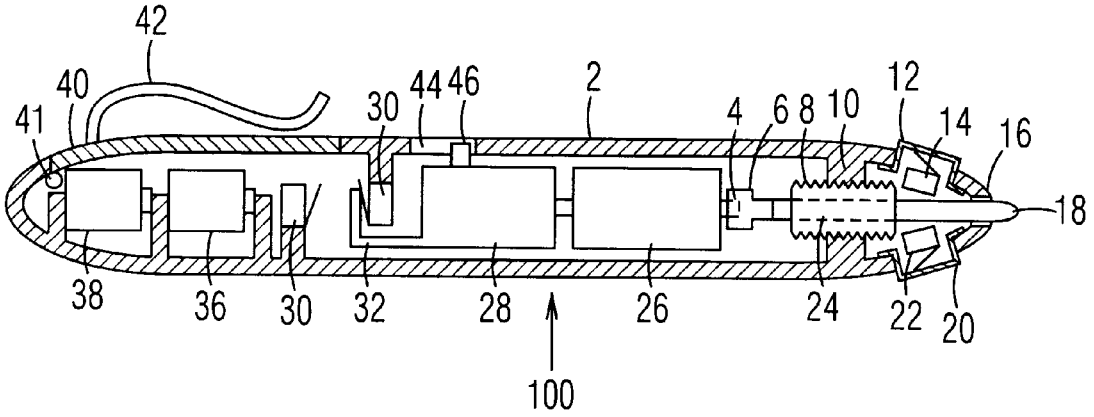
FIG. 2 is a cross-sectional view of the present invention showing the pen cartridge in an extended position.

Referring now to FIG. 1 there is shown a side section view of the pen of the present invention. Pen 2 is shown with cartridge 24 in its retracted state so that pen tip 18 stays within the opening at the end 16 of pen 2. Threaded sleeve 8 is permanently affixed to pen cartridge 24, and stationary nut 10 is integral to pen housing 2. Gear reduction assembly 26 is attached via connector 6 to pen cartridge 24. Shaft 4 is D-shaped in cross section and mating connector 6 has D-shaped receptacle. Motor 28 is attached at the shaft to gear reduction unit 26. When motor 28 is activated by pressing switch button 12 or 20 the entire motor 28, gear 26 and pen assembly 100 slides forward by the interaction of threaded sleeve 8 to integral nut 10. Motor housing 28 is prevented from rotating by the action of attached tab 46 as it slides through slot 44. Right angle tab 32 is fixedly attached to the rear of motor 8. In the retracted mode shown, right angle tab 32 is resting against stop switch 34. In the extended position as shown in FIG. 2, tab 32 is resting against stop switch 30. Batteries 36, 38 are located in the rear of the pen housing 2. Flush door 40 opens via hinge 41 to replace the batteries 36, 38. Pocket clip 42 is attached to door portion 40 as in conventional pens. The user may replace pen cartridge 24 by manually continuing to turn the pen tip 18 in a counter clockwise direction thereby disengaging cartridge 24 from gear reduction assembly connector 6.

Figure 3:
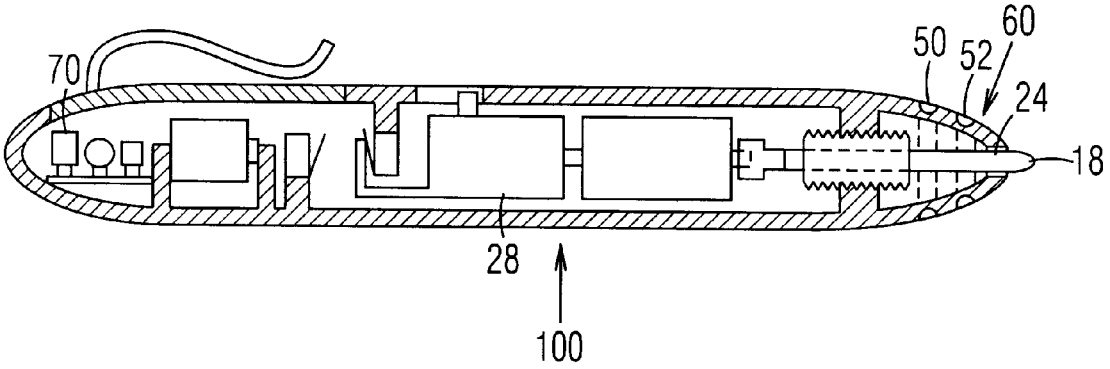
FIG. 3 is a side section of an alternate embodiment of the present invention wherein the actuating means is accomplished by a conductive switch.

FIG. 3 shows a similar cross section; however, instead of manual switches causing the pen assembly 100 to extend and retract, a non-moving conductive switch 60 comprised of a pair of metallic rings 50, 52 are in place. In this configuration the user has only to touch the two closely spaced rings 50, 52 with his or her finger and the motor 28 is activated. This effect adds to the effortlessness of the procedure of activating the pen.

Circuit board 70 controls conductive switch 60.

Figure 4:
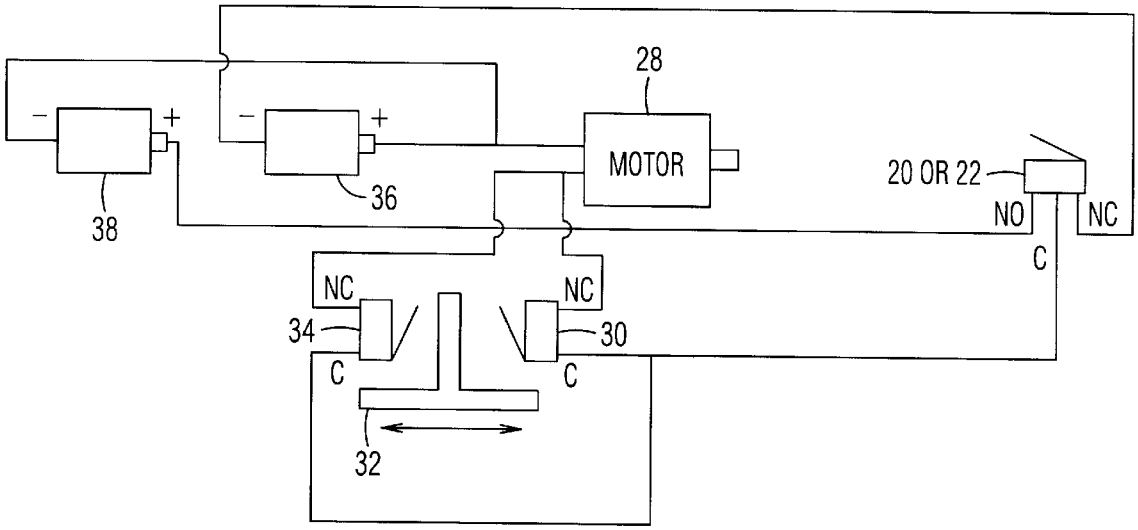
FIG. 4 is a schematic of the electrical circuit used for the operation of the present invention of FIGS. 1 and 2.
Figure 5:
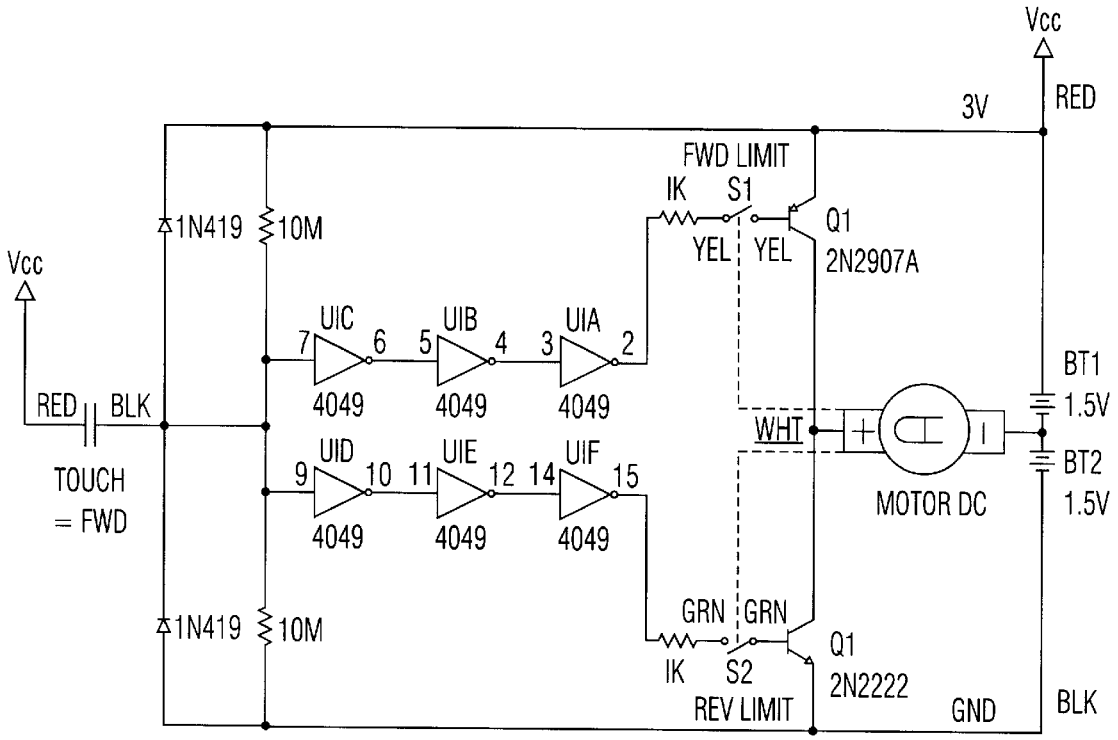
FIG. 5 is a schematic of the electrical circuit of the embodiment of FIG. 3 which uses a conductive switch for actuating the extension - retraction mechanism.

FIG. 4 shows a schematic diagram of the primary embodiment. FIG. 5 shows a schematic diagram of the alternate, conductive switch embodiment.

The overall effect produces an automatic action to extend and retract the pen tip. In this way a manufacturer can produce a novel executive pen which has a new way of feeling expensive, powerful and high tech with or without traditional expensive finishes on the exterior of the housing.

While the invention has been described in connection with a preferred embodiment, it is not intended to limit the scope of the invention to the particular form set forth, but on the contrary, it is intended to cover such alternatives, modifications and equivalents as may be included within the spirit and scope of the invention as defined by the appended claims.

What is claimed is:

1. An electro-mechanically extending and retracting ball point pen, comprising:

a D.C. motor;

a gear reduction assembly; actuator switches;

a pair of limit switches;

a D.C. power supply;

an externally threaded sleeve;

a stationary nut;

a housing; and a pen cartridge and writing tip assembly;

wherein a shaft of said D.C. motor being coupled to a shaft of said gear reduction assembly, an outgoing shaft of said gear reduction assembly being centrally attached to the end of said pen cartridge and writing tip assembly, said externally threaded sleeve being permanently affixed to the outer wall of said pen cartridge and writing tip assembly, said threaded sleeve rotatably mating with said stationary nut, said nut permanently attached to the inside of said housing, said motor, said gear reduction assembly, and said pen cartridge and writing tip assembly being capable of sliding forward and backward within said housing, said motor being activated by said actuator switches, which are located near a front end of said housing and said power supply, said motor, said gear reduction assembly, and said pen cartridge and writing tip assembly being propelled forward when one of said actuator switches energizes said motor, and propelled backward when one said actuator switch is released causing said power supply to reverse polarity which causes said motor to reverse its direction.

2. An electro-mechanically extending and retracting ball point pen as claimed in claim 1 wherein said motor, said gear reduction assembly, and said pen cartridge and writing tip assembly automatically stop at a forward-most position by means of an attached right angle tab making contact with a stationary micro switch attached to one of said limit switches which is attached to said housing and automatically stopping at a rearward-most position by means of an oppositely facing micro switch attached to the other of said limit switches which is attached to said housing.

3. An electro-mechanically extending and retracting ball point pen as claimed in claim 1 wherein said actuator switches are comprised of multiple switches placed in a radial fashion about said housing.

4. An electro-mechanically extending and retracting ball point pen as claimed in claim 1 wherein said pen cartridge and writing tip assembly is replaceable by means of manually unthreading said threaded sleeve from said nut.

5. An electro-mechanically extending and retracting ball point pen as claimed in claim 1 wherein said actuator switches are comprised of skin conductive switches.

6. An electro-mechanically extending and retracting ball point pen as claimed in claim 5 wherein said skin conductive switches are comprised of a plurality of parallel metallic strips that are placed closely enough to each other so that a finger tip will easily touch more than one of said strips at a time thereby completing an electrical circuit which in turn activates said motor.

* * * * *